United States Patent [19]

Chen et al.

[11] Patent Number: 4,936,034

[45] Date of Patent: Jun. 26, 1990

[54] READING STAND WITH PAGE TURNING MECHANISM

[76] Inventors: Chieh-Ju Chen, No. 61, Hsin-Pin Road, Tai-Pin Hsiang Taichung; Chien-Chan Chen, No. 10-66, Wang-Ho Rd., Nan-Twen Dist., Taichung, both of Taiwan

[21] Appl. No.: 338,102

[22] Filed: Apr. 14, 1989

[30] Foreign Application Priority Data

Feb. 4, 1989 [TW] Taiwan ..... 78201247

[51] Int. Cl.[5] ..... G09F 19/00

[52] U.S. Cl. ..... 40/531; 40/341; 84/487; 248/441.1

[58] Field of Search ..... 248/449, 441.1; 40/341, 40/342, 470, 531; 84/486, 487

[56] References Cited

U.S. PATENT DOCUMENTS

| | | | |
|---|---|---|---|
| 2,755,580 | 7/1956 | Justice | 84/487 X |
| 2,791,849 | 5/1957 | Brenneke | 40/531 |
| 2,897,618 | 8/1959 | Russell | 40/531 |
| 4,031,644 | 6/1977 | Rogers | 40/531 X |
| 4,040,195 | 8/1977 | Claypool | 84/487 |
| 4,121,361 | 10/1978 | D'Arcy | 40/470 |
| 4,160,334 | 7/1979 | Willis | 84/487 X |
| 4,553,467 | 11/1985 | Goldner | 84/487 |
| 4,644,675 | 2/1987 | Berger et al. | 40/531 |
| 4,685,374 | 8/1987 | Goldner | 40/470 X |
| 4,780,977 | 11/1988 | Howard et al. | 40/531 |

*Primary Examiner*—Ramon O. Ramirez

*Attorney, Agent, or Firm*—Harness, Dickey & Pierce

[57] ABSTRACT

A reading stand includes a page turning mechanism which has two turning arms extending radially from a rotary shaft located adjacent to an intermediate part of a back plate member. The arms are turned from one side of the shaft to the other side so as to turn a paper sheet of a book held by the reading stand. One of the arms has a paper sheet taking member such as a suction cup and the other arm has a paper sheet pressing member. A motor with a control mechanism operates the arms.

10 Claims, 6 Drawing Sheets

READING STAND WITH PAGE TURNING MECHANISM

BACKGROUND OF THE INVENTION

This application relates to a reading stand, and particularly to a reading stand incorporating a page turning mechanism.

Conventional reading stands are of the type having an inclined back member to support a book or other reading material. Such reading stands, of course, are convenient for those using typewriters, computers and musical instruments. However, for those with physical defects, such reading stands are inconvenient to use. This is because a disabled person frequently cannot turn the pages of a book or some reading material themselves and thus must rely on the aid of another person. Therefore, it is desirable to obtain a reading stand having a mechanical page turning mechanism.

SUMMARY OF THE INVENTION

It is an object of the invention to provide a reading stand incorporating a page turning mechanism which can be operated easily by a person who has physical defect or is an amputee.

Another object of the invention is to provide a reading stand including a page turning mechanism which can be operated conveniently just by depressing a switch.

According to the present invention, a reading stand comprises: a base; an upward back plate means extending from the base having two longitudinal opposite ends, a transverse top edge, and a lower portion which has a transverse seat plate extending from one of the longitudinal ends to the other longitudinal end; a clip means attached to the back plate means to clip a book or the like on the back plate means; a vertical rotary shaft extending from the base and having a top end projecting from the top edge of the back plate means, the rotary shaft being substantially adjacent to an intermediate portion of the back plate means; a first and a second arm pivotally mounted on the top end of the shaft for turning upward and downward and extending radially from the shaft so as to turn from one of the longitudinal ends of the back plate means to the other the longitudinal end, the first arm having a page taking means attached thereto to abut with a page or a paper sheet of the book, the second arm having a paper sheet pressing member attached thereto to clamp a paper sheet against the back plate means after the page taking means releases the paper sheet; and means for operating the first and second arms to turn the paper sheet, the means including a drive means to turn the rotary shaft and the first and second arms, and means for controlling the drive means to turn the first and second arms from one of the longitudinal ends of the back plate means to the other of the longitudinal end as desired.

The exemplary preferred embodiment will be described in detail with reference to the accompanying drawings, in which:

DETAILED DESCRIPTION OF THE PREFERRED EMBODIMENTS

Figure 1:
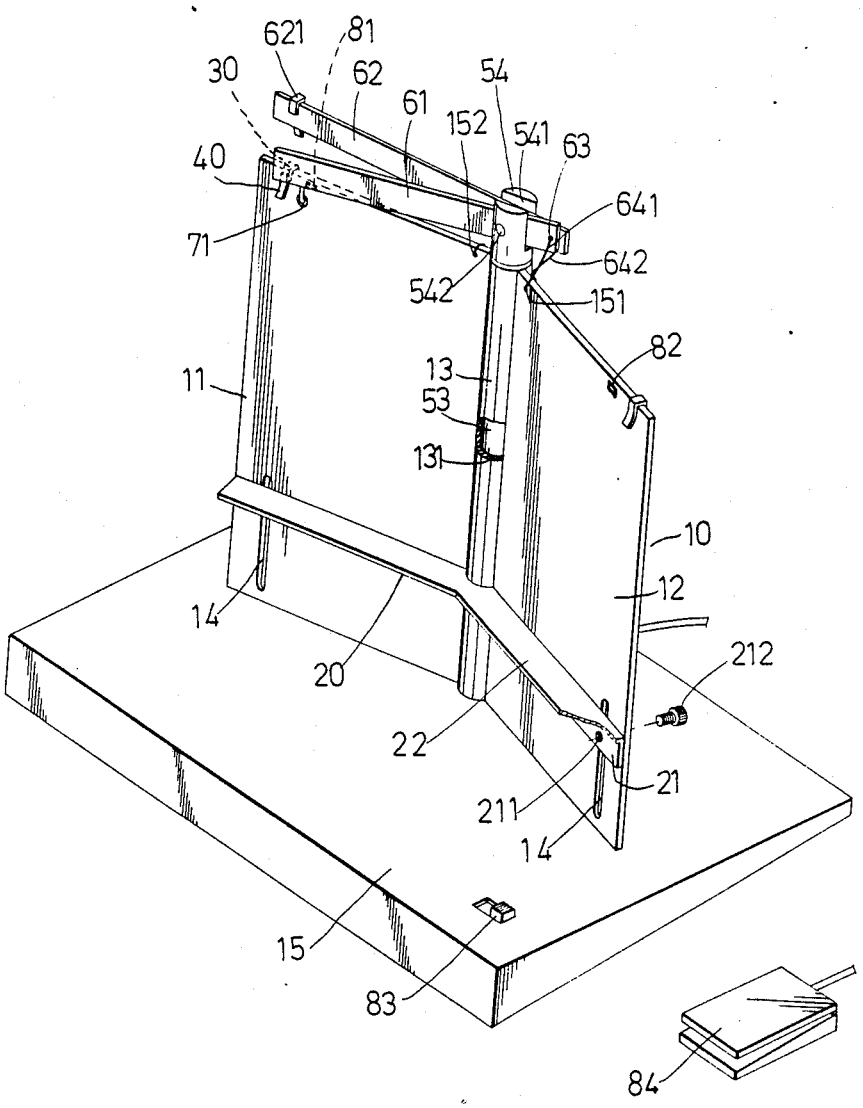
FIG. 1 is a perspective view of a reading stand of the present invention.
Figure 2:
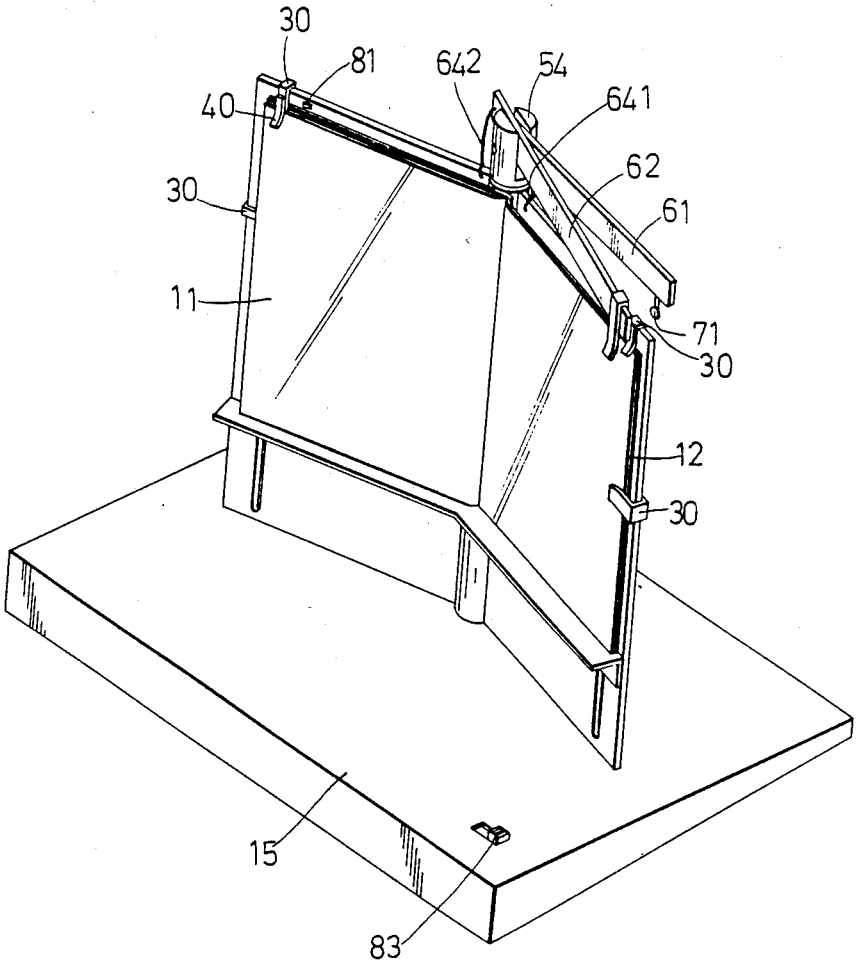
FIG. 2 is a perspective view of the standing stand with a book held thereon.

Referring to FIGS. 1 and 2, a reading stand of the present invention is shown, including a base plate 15 and an upward back plate means 10 extending from the base plate 15. The back plate means 10 includes two back plate members 11 and 12 which are interconnected by a tube member 13 and are inclined to one another. Both back plate members 11 and 12 are provided respectively with longitudinal guide grooves 14. A transverse seat plate 20 substantially normal to the back plate members 11 and 12, extends from one longitudinal end of the back plate member 11 to an opposite longitudinal end of the back plate member 12 and is attached adjustably to the back plate members 11 and 12 by means of the guide grooves 14 in combination with screws 212. The back plate members 11 and 12 are inclined rearward slightly so that a book put on the reading stand can be in the position most suitable and comfortable to be read by the reader.

Four substantially U-shaped clip members 30 are provided at the two opposite longitudinal ends and top edges of the back plate members 11 and 12 to hold the book on the back plate members 11 and 12. These clip members 30 only clamp parts of the book such as front and rear covers and the end pages which are not intended to be read. The paper sheets which bear matters intended to be read are not clipped or clamped by the clip members 30.

One end of a spring plate 40 is attached to the top clip member 30 on the back plate member 11 with one end thereof and extends over the top portion of the pages that are not clipped by the clip member 30. The spring plate clamps these paper sheets and permits them to be easily released.

Figure 3:
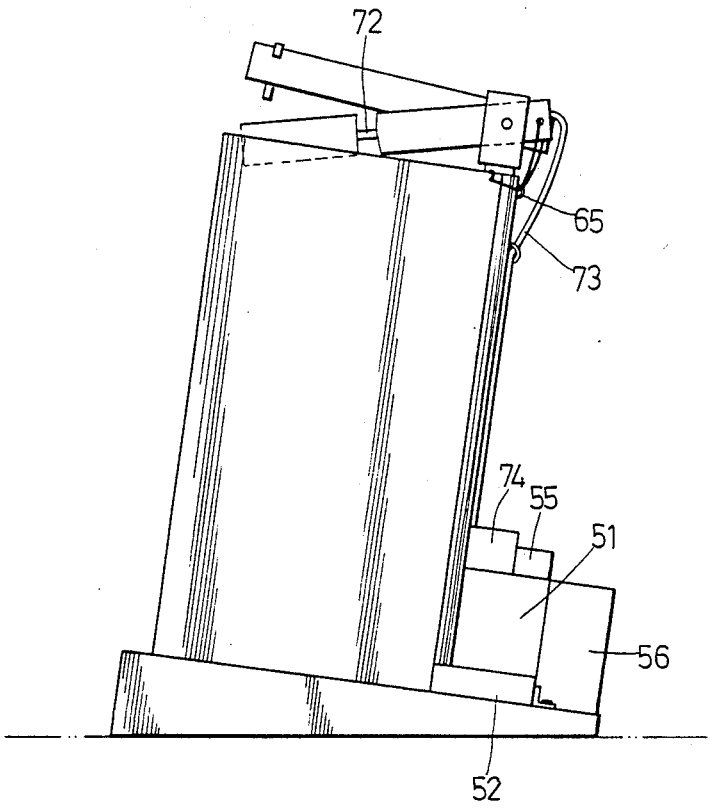
FIG. 3 is a side elevational view of the reading stand.
Figure 4:
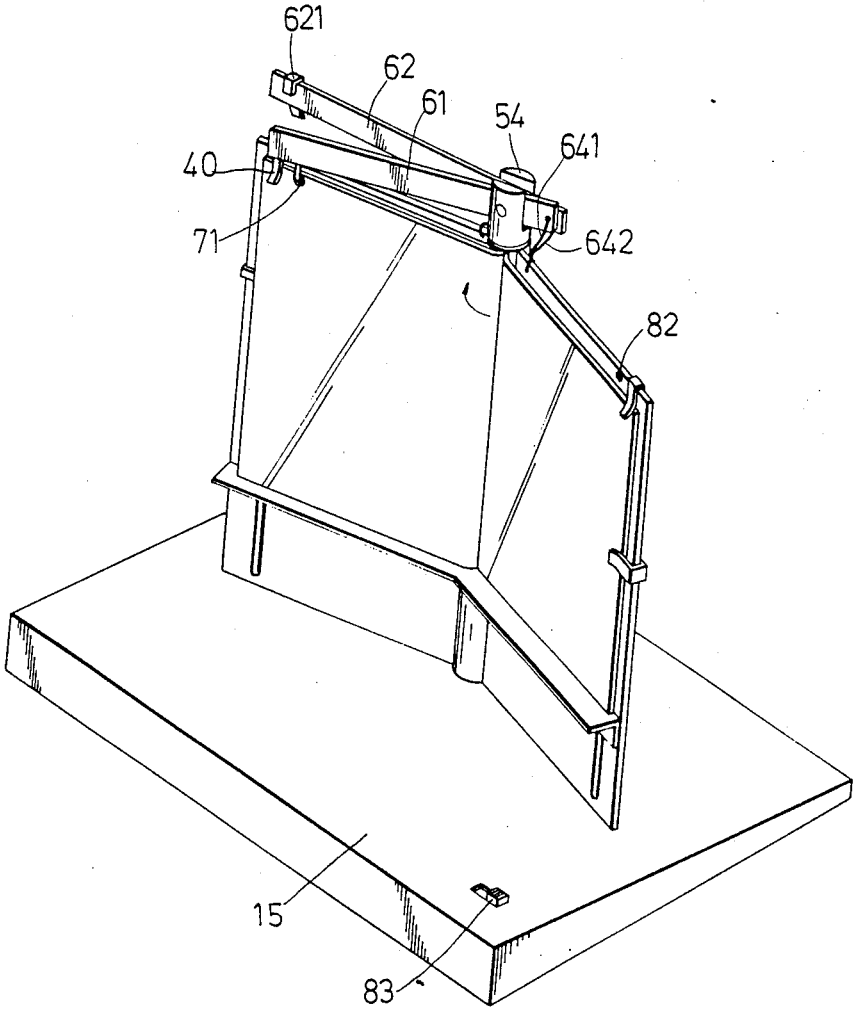
FIGS. 4 and 5 the reading stand in different positions.
Figure 5:
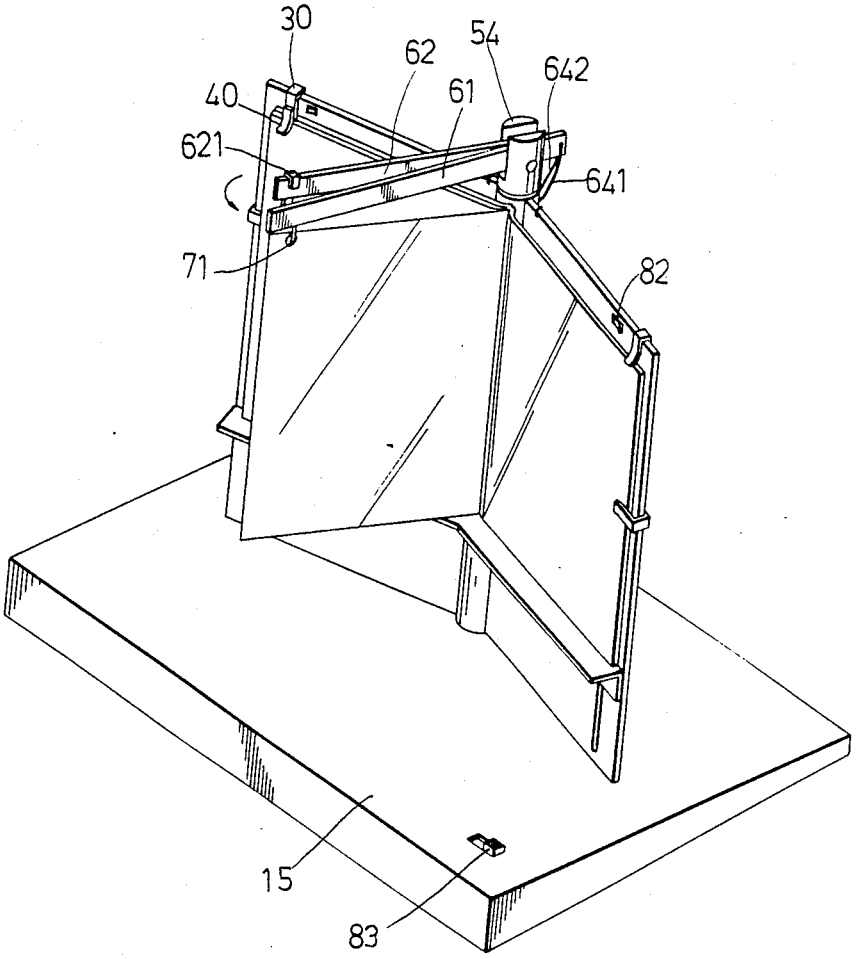

A means for operating the arms 61 and 62 is provided to cause the arms 61 and 62 to turn from the longitudinal end one of the plates 11 or 12 to the other as desired. As shown in FIG. 3, the operating means includes a motor 51 provided at the rear side of the back plate members 11 and 12. The motor 51 is connected to gears (not shown) which are contained in a speed varying gear box 52 and which are connected to a shaft 53 provided in the tube member 13. Numeral 55 represents a control box 55 to control the operating means and numeral 56 represents a casing which houses batteries (not shown).

The top end 54 of the shaft 53 has a diametral groove 541. Two moving arms 61 and 62 are attached to the top end 54 with their ends received in the groove 541 and fulcrumed thereat by means of a pivot pin 542. Slots 63 are provided respectively in the ends of the arms 61 and 62, and two controlling cords 641 and 642 are respectively connected to the arms 61 and 62 by threading through the slots 63. The cord 641 of the arm 61 passes through a ring member 65 attached to the tube member 13 and is secured to a slot 151 of the plate 12. The cord 642 of the arm 62 passes through the ring member 65 and is secured to a slot 152 in the plate member 11.

The arm 62 is further provided with a paper sheet pressing member 621. A paper suctioning means includes a suction cup 71 attached to the arm 61, a conduit 72 connected to the suction cup 71 and extending in the arm 61, a flexible tube 73 connected to the conduit 72 and to a pump contained in a housing 74, which supplies a suction force to the suction cup.

Two microswitches 81 and 82 are respectively provided on the back plate members 11 and 12 and connected to the elements contained in the control box 55. A selective switch 83 is mounted on the base 15 and is electrically connected to the motor. Numerals 84 represents a switch which is to be operated by the foot of the user and which is connected electrically to the control box 55.

As described hereinabove, the book placed on the seat plate member 20 and the back plates 11 and 12 has some paper sheets which are releaseably clamped by the spring plate member 40. The spring plate member 40 permits these releaseably clamped sheets to be turned mechanically by using arms 61 and 62. The arms 61 and 62 can be turned from the left to the right and vice versa by operating the motor. At the beginning of the operation, the arms 61 and 62 are in the position shown in FIG. 2, in which the paper sheets to be turned are clamped by the spring plate 40 at the side of plate 11, the paper pressing member 621 of the arm 62 depresses some paper sheets against the plate member 12, and the arm 61 with the suction cup 71 is slightly above the other arm 62.

When the switch 84 is actuated, the shaft 53 is rotated and the arms 61 and 62 are moved to the left side back plate member 11. In this situation, the controlling cord 642 whose one end is connected to the plate member 11 becomes tensed so that the arm 62 is moved upward. Conversely, the controlling cord 641 whose one end is connected to the plate member 12 becomes loose and the arm 61 is moved downward. When the downwardly moving arm 61 contacts the microswitch 81, the pump 74 starts its operation and causes the suction cup 71 to abut with one of the paper sheets of the book. After a few seconds, the motor starts to operate and the arms 61 and 62 are moved to the right again, carrying the suctioned paper along with the arms 61 and 62. While the arms 61 and 62 are moved to the right, the arm 62 turns gradually downward and guides the turning sheet, and the arm 61 gradually turns upward. When the arm 61 reaches the plate member 12, the microswitch 82 is depressed to stop the operation of the pump and the motor. In this situation, the paper sheet is released from being suctioned and is depressed by the pressing member 621 of the arm 62. The electric circuit of the operating means in this invention is known and therefore the detail thereof is not described herein.

When a next paper sheet is desired to be turned, the switch 84 is operated again to perform a next operation. While the arms 61 and 62 leave for the back plate member 61 to perform the next operation, the paper sheet on the back plate member 62 is still maintained in position since the back plate members are inclined rearward. It can be noted that, during the page turning operation, the arm 61 which incorporates the suction cup should lead the arm 62 which incorporates the paper pressing member.

When a paper sheet of the book is required to be turned from the side of the back plate member 12 to that of the other back plate member 11, the suction cup 71 and the paper pressing member 621 should be interchanged so that the suction cup 71 and the paper passing member 621 are attached respectively to the arms 62 and 61.

Figure 6:
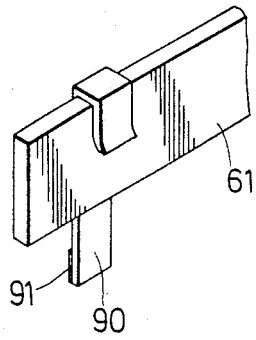
FIG. 6 shows a portion of one of the arms of the reading stand having a pressure sensitive adhesive member.

The suction cup 71 of the present invention can be replaced by a pressure sensitive adhesive element which can adhere to a paper sheet upon being pressed against the paper sheet. In FIG. 6, the pressure sensitive adhesive element is designated at 91 and is attached to a plate member 90 which is attached removably to the arm 61 by being hooked.

With the invention thus explained, it is apparent that various modifications and variations can be made without departing from the scope of the invention. It is therefore intended that the invention be limited only as indicated in the appended claims.

What I claim is:

1. A reading stand comprising:

a base;

an upward back plate means extending from said base having two longitudinal opposite ends, a transverse top edge, and a lower portion which has a transverse seat plate extending from one of said longitudinal ends to the other of said longitudinal ends;

a clip means attached to said back plate means to clip a book or the like on said back plate means;

a vertical rotary shaft extending from said base and having a top end projecting from said top edge of said back plate means, said rotary shaft being substantially adjacent to an intermediate portion of said back plate means;

a first and a second arm pivotally mounted on said top end of said shaft for turning upward and downward and extending radially from said shaft so as to turn from one of said longitudinal ends of said back plate means to the other of said longitudinal end, said first arm having a paper sheet taking member attached thereto to abut with a paper sheet of said book, said second arm having a paper sheet pressing member attached thereto to clamp said paper sheet against said back plate means after said paper sheet taking means releases said paper sheet; and means for operating said first and second arms to turn said paper sheet, said means including a drive means to turn said rotary shaft and said first and second arms, and means for controlling said drive means to turn said first and second arms from one of said longitudinal ends of said back plate means to the other of said longitudinal ends as desired.

2. A reading stand as claimed in claim 1, wherein said back plate means includes two back plate members which form an angle therebetween and a tubular member to interconnect said back plate members.

3. A reading stand as claimed in claim 2, wherein said shaft is provided in said tubular member, said top end of said shaft extending out of said tubular member and having a diametral groove opening at said top end of said shaft.

4. A reading stand as claimed in claim 3, wherein each of said first and second arms has one end thereof received in said diametral groove and fulcrumed at a point in said diametral groove to turn upward and downward, said one end of said first arm having a first cord which has one end attached to said one end of said first arm and the other end connected to said top edge of one of said back plate members, said one end of said second arm having a second cord which has one end attached to said one end of said second arm and the other end connected to said top edge of the other said back plate member.

5. A reading stand as claimed in claim 2, wherein said controlling means includes two first switches respectively provided on said top edges of said two back plate members to be actuated by said first or second arm.

6. A reading stand as claimed in claim 5, wherein said controlling means further includes a second switch provided on said base to be actuated by the foot of a user.

7. A reading stand as claimed in claim 1, wherein said paper sheet taking member and said paper pressing member are removably attached to said first and second arms.

8. A reading stand as claimed in claim 1, wherein said paper sheet taking member is a pressure sensitive adhesive member.

9. A reading stand as claimed in claim 1, in which said paper taking means is a suction cup, wherein said operating means further includes a pump means to provide a suction force to said suction cup.

10. A reading stand as claimed in claim 1, wherein said clip means is provided at said top edge and said longitudinal opposite ends of said back plate means.

* * * * *